United States Patent [19]

Firey

[11] 3,963,006

[45] June 15, 1976

[54] OIL FLOW POSITIVE VALVE DRIVE MECHANISM FOR GASOLINE ENGINES

[76] Inventor: Joseph Carl Firey, 1554 NE. 95th St., Seattle, Wash. 98115

[22] Filed: Sept. 3, 1974

[21] Appl. No.: 502,962

[52] U.S. Cl. ..... 123/90.12; 123/90.13

[51] Int. Cl.[2] ..... F01L 9/02

[58] Field of Search ..... 123/119 R, 119 F, 90.12, 123/90.13

[56] References Cited

UNITED STATES PATENTS

| | | | |
|---|---|---|---|
| 1,763,154 | 6/1930 | Holzwarth | 123/90.12 |
| 2,602,434 | 7/1952 | Barnaby | 123/90.12 |
| 2,615,438 | 10/1952 | Tucker | 123/90.12 |
| 3,257,999 | 6/1966 | Fiedler | 123/90.12 |
| 3,612,015 | 10/1971 | Hausknecht | 123/90.12 |

*Primary Examiner*—Charles J. Myhre
*Assistant Examiner*—Daniel J. O'Connor

[57] ABSTRACT

This invention provides a valve drive mechanism which positively opens and closes the valves of a gasoline engine at all speeds and provides a flow of cooling oil to the valves. Additionally this mechanism permits control of engine torque by delay of the closing of the engine intake valve and thus reduces the emmissions of oxides of nitrogen. This valve drive mechanism consists of oil pumps driving the valve open and closed via selector valves connecting to a hydraulic valve actuator.

5 Claims, 11 Drawing Figures

OIL FLOW POSITIVE VALVE DRIVE MECHANISM FOR GASOLINE ENGINES

CROSS REFERENCES TO RELATED APPLICATIONS

Those objects of this invention relating to the reduction of the emissions of oxides of nitrogen, unburned hydrocarbons and carbon monoxide via the engine exhaust gas are achieved by methods basically similar to those used and described in my earlier patent application entitled, "Improved Gasoline Engine Torque Controller," filing date of Aug. 20, 1973, Ser. No. 389715.

BACKGROUND OF THE INVENTION

1. Field of the Invention

The field of this invention is four stroke cycle, spark ignition, gasoline engines, and, more specifically, the valve driving mechanism and torque control means for such engines.

The term "conventional, four stroke cycle, gasoline engine" is used hereinafter and in the claims to mean the known and conventional combinations of cylinders, cylinder heads, pistons operative within said cylinders and connected to a crankshaft via connecting rods, engine oil supply system, cooling system, spark ignition system, flywheels, starting system, fuel supply system, fuel-air mixing system, exhaust pipes, intake pipes fitted with the usual torque controlling throttle plate, intake valve and intake valve drive mechanism, exhaust valve and exhaust valve drive mechanism, etc., as necessary for the proper operation of said conventional, four stroke cycle gasoline engine. The term "conventional intake valve and exhaust valve driving mechanism" is used hereinafter and in the claims to mean the known and conventional combinations of cams driven at half crankshaft speed to actuate valve lifters and push rods which in turn actuate rocker arms acting directly on the engine intake and exhaust valves to open these valves and return springs acting directly on the engine intake and exhaust valves to close these valves, as used commonly on conventional, four stroke cycle, gasoline engines. The term conventional intake valve and exhaust valve driving mechanism is used hereinafter and in the claims to include also the known and conventional combinations of overhead cams driven at half crankshaft speed to actuate valve lifters acting directly on the engine intake and exhaust valves to open these valves and return springs acting directly on the engine intake and exhaust valves to close these valves, as used occassionally on conventional, four stroke cycle, gasoline engines. The term "usual torque controlling throttle plate" is used hereinafter and in the claims to refer to the throttling valve interposed between the fuel-air mixing device and the intake air pipe connecting to the inlet port of the engine intake valve, said throttling valve acting to control engine torque by throttling the air-fuel mixture on its way into the engine cylinder during the intake stroke and thus reduce the pressure and quantity of the mixture in the cylinder, as used commonly to control torque of conventional, four stroke cycle, gasoline engines.

2. Description of the Prior Art

When the speed of a conventional four stroke cycle gasoline engine, equipped with the conventional intake valve and exhaust valve driving mechanism is increased in order to increase the power output of the engine a speed is finally reached beyond which the engine fails to function properly due to the occurrence of "valve float." Engine valves are said to "float" when the force of the valve closing, return springs is inadequate to overcome the inertia of the mass of the valve, rocker arm, push rod and tappet mechanism and in consequence this mechanism does not follow the cam during the closing of the valve. When the engine designer seeks to prevent valve float by increasing the strength and force of the return spring his efforts are partially offset by the necessarily increased mass and inertia of the return spring itself. Higher engine speeds without valve float can indeed be obtained by using overhead cam shafts which allow reducing the mass whose inertia must be overcome by the return spring. But overhead camshafts are expensive and still have a definite upper limit of engine speed beyond which valve float occurs.

The temperature of the exhaust valves of a conventional four stroke cycle gasoline engine increase rapidly as engine speed is increased due to increased net flow rate of hot exhaust gas over the valve. As a result the exhaust valve deteriorates more rapidly and has a shorter useful life at increased engine speeds.

Some of those problems of the automobile engine created by the shortage of fuel on the one hand and the public desire for reduced exhaust emissions on the other hand can be alleviated if the gasoline engine can be modified to operate properly over a very wide range of speeds. In this way an engine of small displacement can be operated at lower speeds with high efficiency, low fuel consumption, and reduced emissions to propel the vehicle at moderate speed and grade conditions. This same small displacement engine can be operated at higher speeds with high power output to propel the vehicle on steep grades or at high speeds or for rapid acceleration. Since the majority of the running of an automobile engine is at moderate speeds on moderate grades at net improvement in both fuel consumption and exhaust emissions can be realized by substituting the above described small displacement, wide speed range gasoline engine for the present large displacement, moderate speed range gasoline engine required to give the same acceleration, top speed and hill climbing capability. To achieve this desireable, small displacement, wide speed range gasoline engine design will require extensive changes to many portions of the engine, the vehicle transmission and the vehicle drive line but this invention concerns only modifications to the intake valve and exhaust valve driving mechanism so that it will operate properly over a very wide range of engine speeds.

The conventional four stroke cycle gasoline engine operates on the approximate equivalent of the Otto cycle and, in consequence, the temperatures at any point in the engine process do not change appreciably when engine torque is reduced by operating the usual torque controlling throttle plate to throttle the intake air-fuel mixture. Throttling acts to reduce the pressure and density of the intake mixture in the cylinder and in this way the quantity of mixture in the cylinder is reduced and hence the torque is reduced. The temperatures of the air-fuel mixture in the cylinder and of the burned gases after combustion are not, however, appreciably changed by throttling. The concentrations of the undesirable oxides of nitrogen formed during combustion decrease as the temperatures in the cycle are decreased, particularly the maximum temperatures in the cycle following completion of combustion. Hence the oxides of nitrogen concentration in the exhaust gas of a conventional four stroke cycle gasoline engine equipped with the usual torque controlling throttle plate do not change appreciably as engine torque is reduced as is shown in references A and B. This is a serious disadvantage of the conventional four stroke cycle gasoline engine in automobile and other applications where most of the engine operation is at reduced torque settings.

The usual torque controlling throttle plate maldistributes the unevaporated liquid portions of gasoline between the several cylinders of a multicylinder gasoline engine. In consequence some cylinders operate too rich in fuel for the amount of air available and increased quantities of unburned hydrocarbon and carbon monoxide are emitted via the exhaust gas of these cylinders.

Emissions of oxides of nitrogen, unburned hydrocarbons and carbon monoxide by gasoline engines are widely recognized as undesireable since they are pollutants themselves and some of them participate actively in the creation of other types of harmful air pollutants. It is the reduction of these harmful exhaust emissions which constitutes an important beneficial object of my invention.

The usual torque controlling throttle plate produces, at reduced torque, an intake manifold pressure necessarily reduced well below the exhaust manifold pressure and the efficiency of the engine is reduced by the loss due to pumping the gas against this difference in manifold pressure.

SUMMARY OF THE INVENTION

It is an object of this invention to provide a valve drive mechanism for four stroke cycle gasoline engines which positively opens the valve at the desired time in the engine cycle and also positively closes the valve at the desired time in the engine cycle at all speeds of the engine. The conventional engine intake valve and exhaust valve driving mechanism uses cams and connecting linkage to open the valve and springs to close the valve and has an upper speed limit for satisfactory running beyond which the spring cannot close the valve quickly enough. By positively opening and closing the engine valves the valve drive mechanism of this invention permits satisfactory running at higher engine speeds than can be used with the conventional valve driving mechanism and this is one of the beneficial objects of this invention.

The oil flow positive valve drive mechanisim of this invention causes a flow of oil to occur over the stems of the engine intake and engine exhaust valves. In this way these engine valves are cooled by the oil and hence operate at a lower temperature which prolongs the useful life of these engine valves and this is another of the beneficial objects of this invention.

The oil flow positive valve drive mechanism of this invention comprises, a positive displacement oil pump element driven by the engine camshaft or crankshaft which positively displaces oil via a valve opening element into the opening end of a piston and cylinder valve actuator to positively open the engine valve at the proper time and also positively displaces oil via a valve closing element into the closing end of the valve actuator to positively close the engine valve at the desired time. This positive displacement oil pump has displacement well in excess of the valve actuator and this excess flow passes out of the actuator when the valve motion has ceased, via spill ports into a reservoir element and from thence into the engine lubricating oil supply system. The valve opening element consists of a pair of valves, operated by the camshaft at camshaft speed, one of these valves, the supply valve, directing oil from positive displacement oil pump element to the opening end of the valve actuator element, the other valve, the relief valve, allowing oil to escape from the opposite, or closing, end of the valve actuator so that the engine valve is positively opened at the proper time in the engine cycle. The valve closing element is similar to the valve opening element except that it directs oil from the pump element into the closing end of the valve actuator and allows oil to escape from the opposite, or opening, end of the valve actuator at that time in the engine cycle when the valve is to be closed. Both the valve opening element and the valve closing element thus consist of at least two portions, that portion rotating with the camshaft which determines the time of opening and closing of the supply valve and the relief valve, and that non-rotating portion to which the necessary connections are made from the positive displacement oil pump element, to and from the valve actuator element and to the engine oil sump.

A further beneficial object of the oil flow positive valve drive mechanisms described herein is to reduce the quantity of undesireable oxides of nitrogen emitted via the engine exhaust gas of a four stroke cycle, spark ignition gasoline engine when operated at reduced torque.

Another beneficial object of this invention is to reduce the quantities of undesireable unburned hydrocarbons and carbon monoxide emitted via the engine exhaust gas of a four stroke cycle, spark ignition, gasoline engine at reduced torque as compared to the quantities of such emissions from conventional four stroke cycle gasoline engines equipped with the usual torque controlling throttle plate.

Those beneficial objects of this invention relating to reducing the quantities of the several kinds of exhaust emissions are achieved by incorporating in the oil flow positive valve drive mechanisms for all the intake valves on a gasoline engine, as an engine torque control means, devices which delay the closing time of the engine intake valve by an adjustable amount but do not change the opening time of the engine intake valve.

Adjustment of intake valve closing time is achieved on the oil flow positive valve drive mechanism of this invention by making the non-rotating portion of the valve closing element for the intake valve moveable about the engine camshaft through the desired torque control angle of closing time variation. The valve closing element is then fitted with connection means from the positive displacement oil pump, to and from the valve actuator and to the engine oil sump which maintain these connections throughout the full adjustment of the non-rotating portion of the valve closing element through the torque control angle.

In the normal operation of a four stroke cycle gasoline engine the intake valve is opened when the piston is at or near top dead center, and about to begin the intake stroke, and this valve is subsequently closed when the piston is next at or near bottom dead center at the end of the intake stroke. As intake valve closing is longer delayed, beyond this latter bottom dead center position of the piston, an increasing portion of the air-fuel mixture, drawn into the engine cylinder during the intake stroke, is pushed back into the intake manifold as the piston rises during the compression stroke. As a result less air fuel mixture remains within the cylinder to be subsequently burned, the longer intake valve closing is delayed and the engine torque is correspondingly reduced. In this way engine torque and power output may be controlled by adjusting the delay of intake valve closing by use of the devices of this invention.

When engine torque is reduced by delay of intake valve closing, as described above, the compression ratio and thus the compression pressure and temperature, are reduced. In consequence, gas temperatures during combustion and expansion are also reduced. The undesireable oxides of nitrogen are formed during or soon after the combustion process and the quantities formed and surviving to be emitted with the exhaust gas decrease as the gas temperatures are reduced. In this way the device of this invention reduce the emission of oxides of nitrogen at reduced torque, the reduction being greater the greater is the reduction of torque by increasing delay of intake valve closure. Present designs of four stroke cycle gasoline engines control torque by throttling the air fuel mixture on its way into the engine cylinder during the intake stroke and thus reduce the pressure of mixture in the cylinder. But the compression ratio and gas temperatures are not reduced by throttling and, in consequence, the emissions of oxides of nitrogen remain high at part load.

Although delayed intake valve closing reduces the engine compression ratio it does not reduce the expansion ratio upon which the engine efficiency primarily depends. Thus, at part load, an engine using the devices of this invention does not operate upon the equivalent of an Otto cycle but operates rather upon the approximate equivalent of an Atkinson cycle.

When engine torque is controlled by delay of intake valve closure with the devices of this invention the pumping work loss described heretofore does not occur since the pressure is essentially the same in both intake and exhaust manifolds. In this way the devices of this invention improve the part load efficiency of a gasoline engine by eliminating the pumping work loss.

When torque is controlled by use of the devices of this invention no throttle plate is used and the aforementioned maldistribution of liquid gasoline and consequent increased exhaust emissions of unburned hydrocarbons and carbon monoxide do not occur. In this way the devices of this invention act to reduce undesireable emissions of unburned hydrocarbons and carbon monoxide at part load.

BRIEF DESCRIPTION OF THE DRAWINGS

The further detailed description of this invention will refer in part to the accompanying drawings which show particular forms of the invention as follows.

REFERENCES CITED

A. "Engine Speed and Load Effects on Charge Dilution and Nitric Oxide Emissions," by W. R. Aiman, Society of Automotive Engineers, Paper No. 720256, presented January 1972 SAE meeting.

B. "Exhaust Emissions from Small, Utility, Internal Combustion Engines," by Messrs. B. H. Eccleston and R. W. Hurn, Society of Automotive Engineers, Paper No. 720197, presented January 1972 SAE meeting.

DESCRIPTION OF THE PREFERRED EMBODIMENTS

Figure 1:
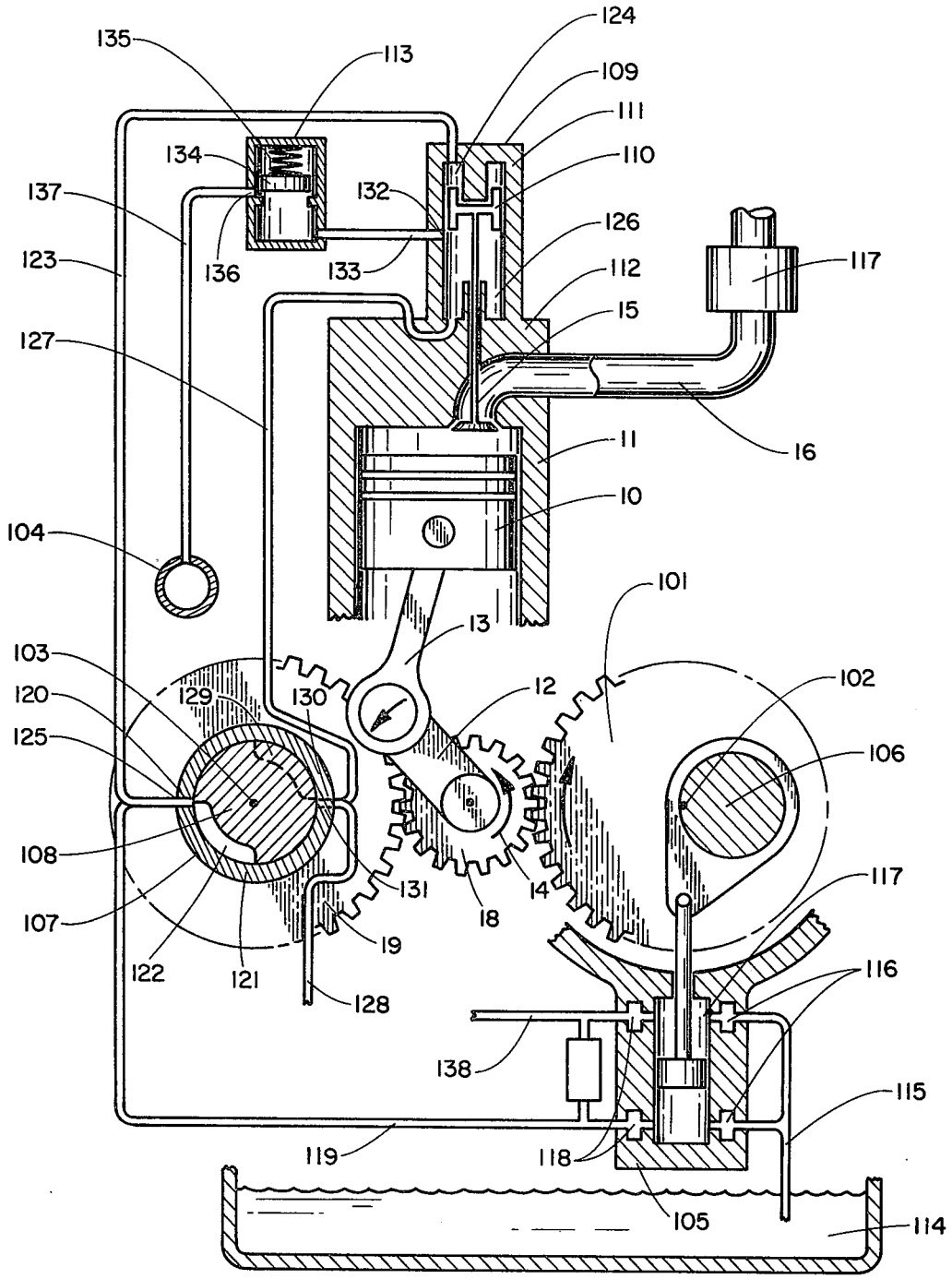
FIG. 1 shows in outline an assembly of a portion of an oil flow positive valve drive mechanism installed on a gasoline engine.

A preferred embodiment of the oil flow positive valve drive mechanism of this invention is shown in part in FIG. 1 as installed on a conventional four stroke cycle gasoline engine. Only those portions of the conventional four stroke cycle gasoline engine as relate to this invention are shown in FIG. 1 as follows:

The engine piston, 10, operative within the engine cylinder, 11, is shown connecting to the engine crankshaft, 12, via the engine connecting rod, 13, and at slightly after top dead center at the start of the engine intake stroke with crankshaft rotation as indicated by the arrow, 14. The engine intake valve, 15, is starting to open so that as the piston, 10, descends on the intake stroke fresh air-fuel mixture will be drawn into the engine cylinder, 11, from the engine intake air system, 16, via the fuel-air mixing device, 17. The crankshaft timing gear, 18, drives the camshaft timing gears, 19 and 101, and hence the engine camshafts about their centerlines, 102 and 103, at exactly one half the crankshaft speed. Two engine camshaft centerlines, 102 and 103, and two camshaft timing gears, 19 and 101, are shown in FIG. 1, but this is done only to improve the clarity of FIG. 1, as in common usage a single engine camshaft and camshaft timing gear will suffice. The engine oil supply system manifold, 104, which supplies lubricating oil under pressure to the several bearings and rubbing surfaces within the gasoline engine is also shown in FIG. 1.

The improvement of this invention comprises; removing the usual torque controlling throttle plate, commonly located just beyond the fuel-air mixing device, 17, and in the engine intake air system, 16, and additionally replacing the conventional intake valve and exhaust valve driving mechanisms with oil flow positive valve drive mechanisms. The portion of an oil flow positive valve drive mechanism shown in FIG. 1 comprises the following elements:

a. A positive displacement oil pump element, 105, positively driven by an eccentric, 106, on the engine camshaft, 102.

b. A valve opening element, 107, whose rotating cylindrical passage component, 108, is driven at the speed of the camshaft, 103.

c. A valve actuator element, 109, which is a double acting piston and cylinder actuator whose actuator piston, 110, connects to, or is integral with, the engine intake valve, 15, and whose actuator cylinder, 111, connects to or is integral with the engine cylinder head, 112.

d. An oil reservoir element, 113, from which oil can discharge into the engine oil supply system manifold, 104.

Additionally required to complete the oil flow positive valve drive mechanism, and not shown in FIG. 1, is a valve closing element, whose mechanical functioning is similar to that of the valve opening element, 107, except that it closes the engine intake valve as described in detail hereinafter.

The several elements of the oil flow positive valve drive mechanism connect to the various portions of the conventional four stroke cycle gasoline engine as described above and, further, connect together and function together as follows:

e. The double acting positive displacement oil pump element, 105, draws engine lubricating oil from the engine lubricating oil sump, 114, via the suction pipe, 115, and the pressure actuated suction valves, 116, and discharges oil via the pressure actuated discharge valves, 118, into the connection, 119, to the non rotating pressure supply port, 120, in the non rotating port ring, 121, portion of the valve opening element, 107.

f. The valve opening element, 107, directs the oil, coming from the positive displacement oil pump element, 105, via the connection 123 to the opening end, 124, of the valve actuator element, 109, at the time in the engine cycle when the engine valve is to be opened. This is done by having the camshaft, 103, index the pressure passage, 122, in the rotating cylindrical passage component, 108, with the non rotating pressure supply port, 120, and simultaneously with the non rotating pressure delivery port, 125, which is axially directly in front of the pressure supply port, at that time in the engine cycle when the valve is to start opening. The pressure passage, 122, is of about 90 camshaft degrees in angular extent and hence the aforedescribed indexing with the ports, 120 and 125, is maintained for about 90° camshaft.

Additionally the valve opening element, 107, allows return flow of oil to occur from the closing end, 126, of the valve actuator, 109, to the engine oil sump, 114, via the connections, 127 and 128, so that the engine valve, 15, can open. This is done by having the camshaft, 103, index the relief passage, 129, in the rotating cylindrical passage component, 108, with the non rotating pressure relief port, 130, and simultaneously with the non rotating vent port, 131, which is axially directly in front of the pressure relief port, at that time in the engine cycle when the spill ports, 132, in the valve actuator element, 109, have been covered by the actuator piston, 110. The relief passage, 129, is of about 90 camshaft degrees in angular extent and hence the aforedescribed indexing with the ports, 130 and 131, is maintained for about 90° camshaft.

g. In the valve actuator element, 109, the actuator piston, 110, is forced downward and hence the engine valve, 15, is opened whenever engine lubricating oil is directed under pressure from the positive displacement oil pump element, 105, into the opening end, 124, of the valve actuator element, while concurrently the oil in the closing end, 126, of the valve actuator is allowed to return flow via the connection, 127, to the engine oil sump, 114. When the engine valve, 15, is fully opened the spill ports, 132, in the valve actuator element are uncovered by the actuator piston, 110, and thereafter the oil delivered by the positive displacement oil pump element, 105, to the valve actuator element, 109, flows as a cooling medium past the actuator piston, 110, through the spill ports, 132, and into the oil reservoir element, 113, via the connection, 133.

The valve actuator element, 109, is also fitted with cushion pistons and cylinders to gradually slow down the valve to a stop and the construction and operation of these cushion pistons and cylinders will be described in detail hereinafter.

h. The oil reservoir element, 113, receives the flow of oil from the positive displacement oil pump element, 105, via the valve actuator element, 109, while holding a back pressure on the oil by action of the reservoir piston, 134, and reservoir piston spring, 135. This back pressure, acting through the connection, 133, and the spill ports, 132, of the valve actuator element, 109, holds the actuator piston, 110, and hence the engine valve, 15, fully open once it has been fully opened, and fully closed once it has been fully closed. Hence the engine valve, 15, will not change position except as controlled by the valve opened element, 107, as described heretofore or the valve closing element as will be described hereinafter. The flow of oil into the oil reservoir element, 113, moves the reservoir piston, 134, against the reservoir piston spring, 135, until the piston uncovers the relief port, 136, and thereafter the flow of oil is directed into the engine oil supply system manifold, 104, via the connection, 137.

Not shown in FIG. 1, but essential to proper operation of the oil flow positive valve drive mechanisms of this invention, is the valve closing element. The valve closing element performs the same function as the valve opening element and by the same method except that it directs oil under pressure from the positive displacement oil pump element, 105, via the connection, 138, into the closing end, 126, of the valve actuator element, 109, and concurrently allows return flow of oil to occur from the opening end, 124, of the valve actuator element, 109, to the engine oil sump, 114, so that the engine valve, 15, can close at the proper time in the engine cycle. To achieve all of the beneficial objects of this invention two different kinds of valve closing elements are used, an exhaust valve closing element and an intake valve closing element. The exhaust valve closing element is similar to the valve opening element described heretofore except that it acts to close the engine exhaust valve at the desired time when the engine piston is at or near top dead center at the end of the exhaust stroke. The intake valve closing element is also similar to the valve opening element described heretofore except that it acts to close the engine intake valve at any chosen time between the usual intake valve closing time when the engine piston is at or near bottom dead center at the end of the intake stroke to any desired later closing time during the compression stroke until slightly before the time when the engine ignition spark is fired. This variation of intake valve closing time is used to control the engine torque and is accomplished by adjusting the non-rotating port ring containing the pressure supply port, the pressure delivery port, the pressure relief port and the vent port, angularly about the camshaft centerline, 103, and hence angularly with respect to the rotating cylindrical passage component via a torque control lever secured to the non-rotating port ring. To maintain proper and continuous connections between the non-rotating but adjustable port ring and the appropriate supply and delivery connections from the positive displacement oil pump element, 105, to and from the valve actuator element, 109, and to the engine oil sump, 114, throughout the full adjustment of the non-rotating port ring, a stationary hollow cylindrical connection ring is fit closely around the non-rotating port ring of the intake valve closing element.

Having thus described a preferred form of the oil flow positive valve drive mechanisms of this invention, how it is connected to the various portions of a conventional four stroke cycle gasoline engine and how the several elements are connected together and how they function together, detailed descriptions of each of the several elements, and some of their various useable forms, will now be presented together with further details of their operation.

Figure 2:
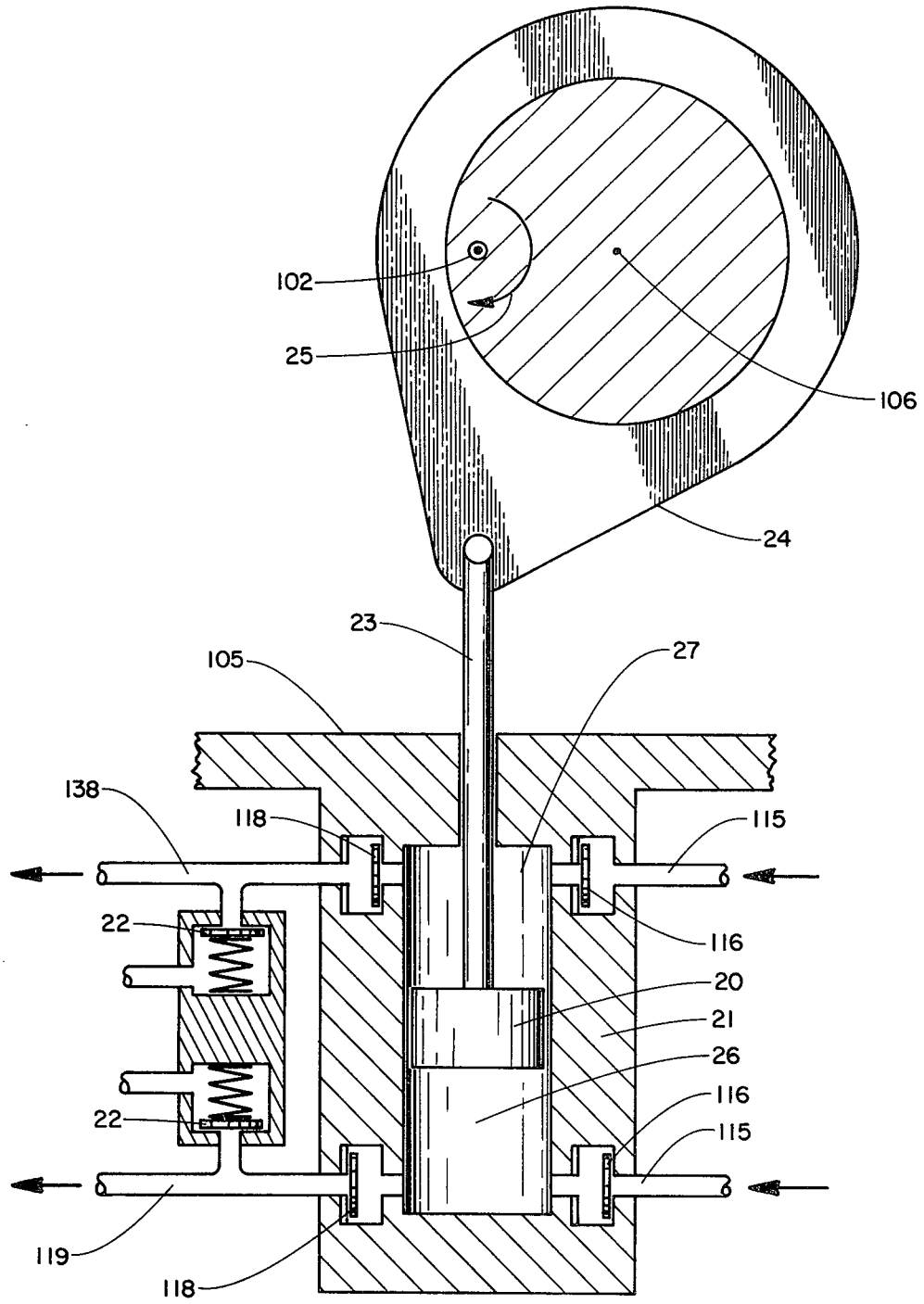
FIG. 2 shows in outline one form of positive displacement oil pump element.

The positive displacement oil pump element, 105, shown in detail in FIG. 2, is a double acting single cylinder and piston oil pump comprising the usual pump piston, 20, pump cylinder, 21, pressure actuated suction valves, 116, pressure actuated discharge valves, 118, overpressure relief valves, 22, pump piston rod, 23, eccentric strap, 24, and driving eccentric, 106, which latter is a portion of the engine camshaft, 102, whose rotation for FIG. 2 is shown by the arrow, 25. This positive displacement oil pump element is shown in FIG. 2 in the same operating position as in FIG. 1, with the pump piston, 20, moving away from the camshaft, 102, and hence delivering oil under pressure from that end, 26, of the pump cylinder, 21, away from the camshaft, 102, via the pressure actuated discharge valve into the connection, 119, to the valve opening element, and hence also drawing engine lubricating oil from the engine lubricating oil sump via the suction pipe, 115, and the pressure actuated suction valve into that end, 27, of the pump cylinder, 21, toward the camshaft, 102.

In the running of a conventional four stroke cycle gasoline engine it is desireable that the engine intake valve and the engine exhaust valve be opened as quickly as possible in order to minimize pressure drop and consequent engine power loss due to throttling flow past the partially opened engine valve. For this reason it is preferred that the positive displacement oil pump element be sized, connected, and timed as follows:

i. The displacement of the positive displacement oil pump element, defined as the product of the area of the pump piston, 20, and the pump piston stroke length, is made at least 4 times and preferably at least 10 times the displacement of the valve actuator element, defined as the product of the area of the actuator piston, 110, and the engine valve lift. In this way only a portion of the pump piston stroke length and hence only a portion of the time of a full pump piston stroke is used for the opening and for the closing of the engine valve. As a minimum it is essential that the engine valve be fully opened within the first 90 crankshaft degrees, and hence the first 45 camshaft degrees, which follow the commencement of the engine valve opening. In consequence the ratio of the displacement of the positive displacement oil pump element to the displacement of the valve actuator element should have a value of at least 4.

j. The end, 26, of the pump cylinder, 21, away from the camshaft, 102, delivers oil under pressure via the connection, 119, to the valve opening element and the end, 27, of the pump cylinder, 21, toward the camshaft, 102, delivers oil under pressure via the connection, 138, to the valve closing element. The displacement of the positive displacement oil pump element from the end, 26, away from the camshaft is greater than the displacement of the positive displacement oil pump element from the end, 27, toward the camshaft by the amount of pump displacement lost to the pump piston rod, 23. With these connections engine valve opening may be accomplished more quickly than engine valve closing and this is usually preferred since power is lost largely due to occurrence of throttling during valve opening.

k. The eccentric, 106, is positioned angularly on the camshaft, 102, so that the pump piston, 20, passes its maximum velocity point approximately 90° crankshaft before the engine piston reaches its top dead center position. A further requirement for the angular positioning of the eccentric, 106, on the camshaft, 102, is that the pump piston, 20, is moving away from the camshaft when the engine valve is to be opened and is moving toward the camshaft when the engine valve is to be closed. This timing of the pump insures that a reasonably high value of pump piston velocity and hence oil displacement velocity will prevail both when the engine valve is to be opened and also when the engine valve is to be closed, even though the maximum pump piston velocity is not then used for the opening of the valve.

Any of the several different kinds of positive displacement oil pumps, such as gear pumps or duplex cylinder and piston pumps, could be used as the positive displacement oil pump element of this invention, in lieu of the single cylinder and piston, double acting type of positive displacement oil pump element described above. When used on a multicylinder gasoline engine, the oil being discharged under pressure from any one positive displacement oil pump element, of whatever kind, is to be directed to only one valve actuator element at any one time in the engine cycle. This latter requirement insures that a single positive displacement oil pump element is not called upon to actuate two different valve actuator elements at the same time, since in this latter case one of the valve actuators might not function properly. For duplex cylinder and piston pumps and gear pumps with a large number of gear teeth the oil discharges from the pump at a nearly steady flow rate, and thus when pumps of these kinds are used as positive displacement oil pump elements the pump may be positively driven by either the engine camshaft or the engine crankshaft.

Figure 3:
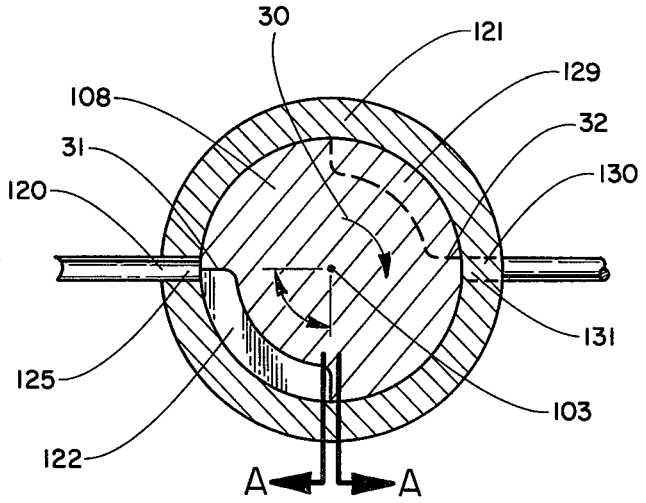
FIG. 3 shows in outline one form of valve opening element or exhaust valve closing element.
Figure 4:
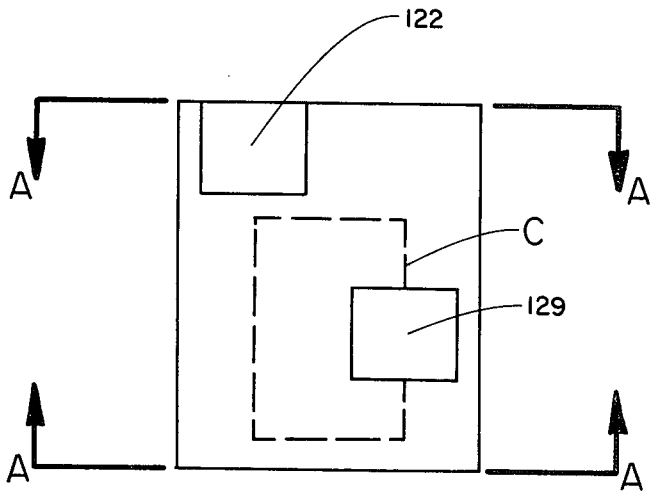
FIG. 4 shows a developed view of the moving ports portion of the valve opening element shown in FIG. 3 along the developed arc cross section A—A.
Figure 5:
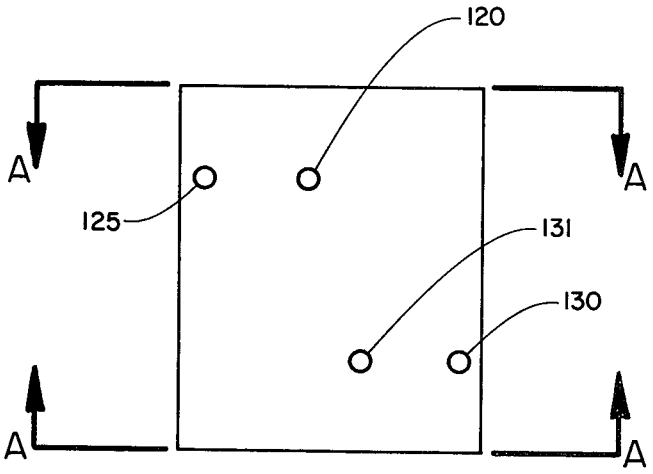
FIG. 5 shows a developed view of the non-rotating ports portion of the valve opening element shown in FIG. 3 along the developed arc cross section A—A.

A valve opening element, 107, is shown in a cross section normal to the camshaft centerline, 103, in FIG. 3, with a developed arc cross section, A—A, of the interior surface of the non-rotating port ring, 121, shown in FIG. 5, and a developed arc cross section, A—A, of the exterior surface of the rotating cylindrical passage component, 108, shown in FIG. 4, and comprises the following two components:

1. A non-rotating hollow cylindrical port ring, 121, containing four ports; a pressure supply port, 120, connected externally to the postiive displacement oil pump element, 105, via the connection, 119; a pressure delivery port, 125, connected externally to the opening end, 124, of the valve actuator element, 109, via the connection, 123; a pressure relief port, 130 connected externally to the closing end, 126, of the valve actuator element, 109, via the connection, 127; a vent port, 131, connected externally to the engine lubricating oil sump, 114, via the connection, 128;
2. a rotating cylindrical passage component, 108, fitted closely for sealing purposes to the interior of the non-rotating hollow cylindrical port ring, 121, and being integral with or connected directly to the engine camshaft, 103, and hence rotating at chamshaft speed in the direction shown by the arrow, 30, and containing two separate passages; a pressure passage, 122, which indexes with both the pressure supply port, 120, and the pressure delivery ports, 125; and a relief passage, 129, which indexes with both the pressure relief port, 130, and the vent port, 131; these two passages being displaced along the camshaft centerline, 103, relative to each other so that the pressure passage, 122, cannot index with the vent port, 131, and so that the relief passage, 129 cannot index with the pressure supply port, 120; both the pressure passage, 122, and the relief passage, 129, are of an angular extent of about 90° camshaft.

The pressure passage, 122, and the relief passage, 129, are positioned angularly on the rotating cylindrical passage component, 108, relative to the pair of pressure ports, 120 and 125, and the pair of relief ports, 130 and 131, so that the pressure supply port, 120, is first connected via the pressure passage, 122, to the pressure delivery port, 125, at that time in the engine cycle when the valve is to start opening, and so that the pressure relief port, 130, is first connected via the relief passage, 129, to the vent port, 131, at that somewhat later time in the engine cycle when the spill ports, 132, in the valve actuator element, 109, have been covered by the actuator piston, 110. For example, when the pair of pressure ports, 120 and 125, are located at 180° camshaft directly opposite the pair of relief ports, 130 and 131, as shown in FIG. 3, the pressure passage leading edge, 31, will be 180 degrees less the valve actuator spill port covering delay angle behind the leading edge, 32, of the relief passage, 129, in the direction of rotation, 30.

The exhaust valve closing element can be of identical mechanical construction to the aforedescribed valve opening element and is connected to the valve actuator element, the engine lubricating oil sump, and the closing end of the positive displacement oil pump element, which in FIG. 2 is the pump cylinder end toward the camshaft, as described heretofore, so that it acts to close the engine exhaust valve at the desired time in the engine cycle.

The intake valve closing element differs from the above described exhaust valve closing element in that provision is made to adjust the time of intake valve closing in order to control engine torque. This adjustment is made by moving the non-rotating port ring angularly about the camshaft centerline and then providing for maintaining the necessary external connections to the port ring throughout the adjustment angle. The desired range of adjustment of the engine intake valve closing time, hereinafter and in the claims referred to as the torque control angle, is between the conventional intake valve closing time when the engine piston is at or near bottom dead center at the end of the intake stroke to intake valve closing times later than this during the compression stroke up to but not including the time of firing of the engine ignition spark, which latter is commonly some few crankshaft degrees before top dead center of the engine piston on the compression stroke. The torque control angle is herein expressed in camshaft degrees which are thus one half of the corresponding crankshaft degrees.

Figure 6:
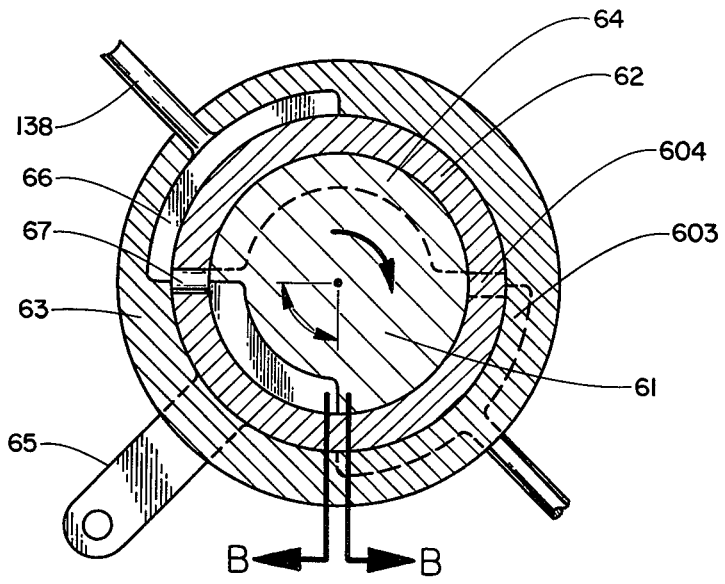
FIG. 6 shows in outline one form of intake valve closing element.
Figure 7:
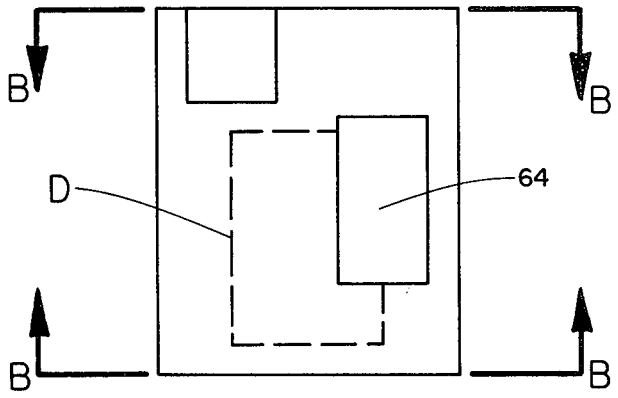
FIG. 7 shows a developed view of the moving ports portion of the intake valve closing element shown in FIG. 6 along the developed arc cross section B—B.
Figure 8:
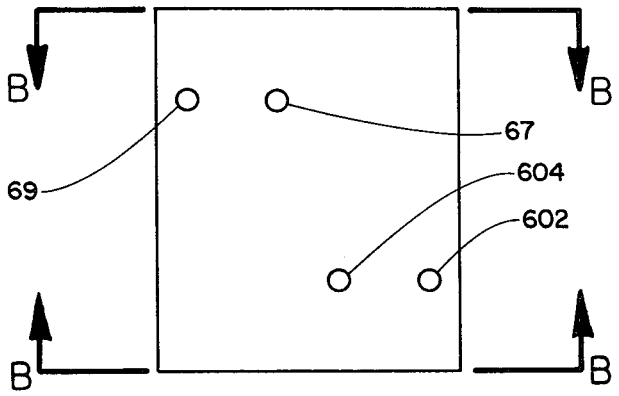
FIG. 8 shows a developed view of the non-rotating ports portion of the intake valve closing element shown in FIG. 6 along the developed arc cross section B—B.
Figure 9:
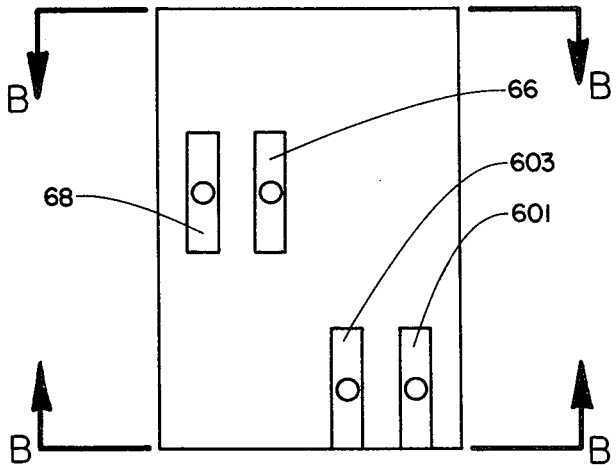
FIG. 9 shows a developed view of the stationary connection unit of the intake valve closing element shown in FIG. 6 along the developed arc cross section B—B.

An intake valve closing element is shown in a cross section normal to the camshaft centerline in FIG. 6, with a developed arc cross section, B—B, of the exterior surface of the rotating cylindrical passage component, 61, shown in FIG. 7, and with a developed arc cross section, B—B, of the interior surface of the non-rotating adjustable port ring, 62, shown in FIG. 8, and with a developed arc cross section, B—B, of the interior surface of the stationary hollow cylindrical connection unit, 63, shown in FIG. 9. The non-rotating adjustable port ring, 62, and the rotating cylindrical passage component, 61, are seen to be identical to the corresponding portions of the valve opening element shown in FIG. 3, except that the relief passage, 64, has a greater angular extent than the relief passage, 129, in order to accommodate the longer duration of valve opening possible, and the non-rotating adjustable port ring, 62, has the torque control lever, 65, secured to it. The relief passage, 64, has an angular extent of 90 camshaft degrees plus the torque control angle. Control of engine torque is accomplished by movement of the torque control lever, 65, and hence of the non-rotating adjustable port ring, 62, either directly or via whatever additional connecting linkage is convenient. Hence engine torque may be controlled by hand movement of the torque control lever, 65 (as for example in both applications), or by foot movement of the torque control lever, 65 (as for example in automobile applications), or by engine governor mechanism movement of the torque control lever, 65 (as for example in electric generating applications), either directly or via whatever additional connecting linkage is convenient, as is well known in the art. The stationary connection unit, 63, is provided to maintain the necessary external connections to the non-rotating adjustable port ring, 62, and is a hollow cylindrical ring fitted closely for sealing purposes to the exterior of the non-rotating adjustable port ring, 62. Individual supply grooves are recessed into the interior cylindrical surface of the stationary connection unit, 63, the angular extent of each of these supply grooves being somewhat greater than the torque control angle. Each such supply groove is positioned along the axial dimension of the connection unit, 63, so as to index with the corresponding port in the non-rotating adjustable port ring, 62, and is of at least the same axial width as these ports, and is connected externally to the desired connection as follows:

1. The pressure supply groove, 66, connects externally to the pressure discharge outlet, 138, from the closing end of the positive displacement oil pump element, 105, and indexes with the pressure supply port, 67, in the non-rotating adjustable port ring, 62.
2. The pressure delivery groove, 68, connects externally to the closing end, 126, of the intake valve actuator element, 109, and indexes with the pressure delivery port, 69, in the non-rotating adjustable port ring, 62.
3. The pressure relief groove, 601, connects externally to the opening end, 124, of the intake valve actuator element, 109, and indexes with the pressure relief port, 602, in the non-rotating adjustable port ring, 62.
4. The vent groove, 603, connects externally to the engine lubricating oil sump, 114, and indexes with the vent port, 604, in the non-rotating adjustable port ring, 62.

When the pressure passage in the rotating cylindrical passage component no longer connects the pressure supply port to the pressure delivery port, in a valve opening element or a valve closing element, the extra oil flow thereafter discharging under pressure from the positive displacement oil pump element has no place to go. In consequence the overpressure relief valves, 22, on the positive displacement oil pump element are opened by the increase of oil discharge pressure and the extra oil flow is thereby throttled back into the engine lubricating oil sump through these overpressure relief valves. But this method of accommodating the extra oil flow requires a high work input into the positive displacement oil pump element and thus reduces engine efficiency. This particular engine efficiency loss can be minimized by extending the relief passage in the rotating cylindrical passage component of the valve opening element and the valve closing element so that it connects the pressure supply port to the vent port in the non-rotating hollow cylindrical port ring at all angular positions of the rotating cylindrical passage component except those angular positions close to and including those when the pressure passage connects the pressure delivery port to the pressure supply port. This extension of the relief passage, 129, in the rotating cylindrical passage component, 108, of the valve opening element, 107, is shown by the dotted line, C, in FIG. 4. Correspondingly this extension of the relief passage, 64, in the rotating cylindrical passage component, 61, of the intake valve closing element shown in FIG. 6 is shown by the dotted line, D, in FIG. 7. Extended relief passages of this description can only be used when one double acting, single cylinder and piston pump type of positive displacement oil pump element is used for each engine intake valve and for each engine exhaust valve.

The mechanical features of the valve opening elements and valve closing elements described above are seen to be those of timed, port indexing valves and it is evident that other types of valves, such as poppett valves, can also be used in lieu of port indexing valves. For example, to use poppett valves, the rotating cylindrical passage component would be replaced in part by a pair of cams, driven directly by or integrally with the engine camshaft. These cams would then open and close a pair of poppett valves which would replace the non-rotating port ring and the passage portions of the rotating cylindrical passage component to accomplish the same opening and closing of the engine valves as is accomplished by use of port indexing valves. One of these poppett valves, the supply valve, when open would direct oil from the positive displacement oil pump element to the appropriate end of the valve actuator element and the other of these poppett valves, the relief valve, when open would direct return flow of oil from the opposite end of the valve actuator element to the engine oil sump. The timed, port indexing valve form of valve opening element and valve closing element, as described heretofore, is considered preferable because easier and less costly to manufacture, but it is not intended to limit this invention to only this one type of valve.

Figure 10:
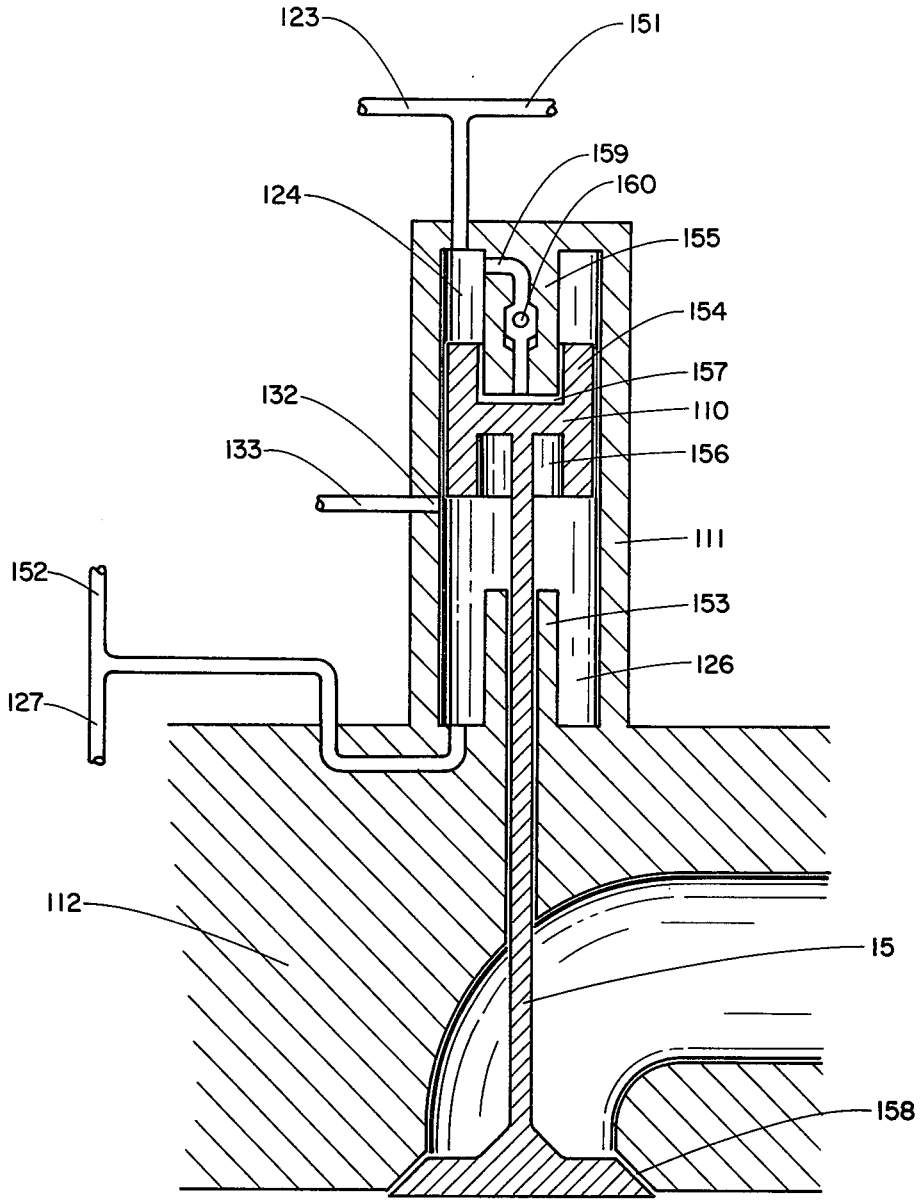
FIG. 10 shows a cross section view of a typical valve actuator element secured to the engine valve and the engine frame as shown.

The valve actuator element, 109, shown in detail in FIG. 10, is a double acting piston and cylinder actuator whose actuator piston, 110, connects to, or is integral with, the engine valve, 15, and fits closely for sealing purposes to the interior bore of the closed ends actuator cylinder, 111, which latter is secured to the engine cylinder head, 112. Oil flow connections are made to the valve actuator element, 109, as follows for an intake valve actuator element:

1. the opening end, 124, of the valve actuator connects to the pressure delivery port, 125, of the valve opening element, 107, via the connection, 123, and also to the pressure relief groove, 601, of the valve closing element shown in FIG. 6, via the connection, 151;
2. the closing end, 126, of the valve actuator connects to the pressure delivery groove, 68, of the valve closing element shown in FIG. 6, via the connection, 152, and also to the pressure relief port, 130, of the valve opening element, 107, via the connection, 127;
3. the spill port, 132, located in the center of the complete motion path of the actuator piston, 110, within the actuator cylinder, 111, connects to the oil reservoir element, 113, via the connection, 133.

The corresponding connections for an exhaust valve actuator element are similar except that those made to the valve closing element are made directly to the ports in the non-rotating port ring of the exhaust valve closing element.

It is preferable that the spill port, 132, be only just fully opened when the actuator piston, 110, is stopped either by the closing of the engine valve, 15, or by coming up against the opening cushion piston, 153, when the engine valve is fully open. Hence the axial length of the cylinder wall sealing portion, 154, of the actuator piston, 110, shall be less than the total engine valve lift by the height of the spill port, 132.

To bring the engine valve, 15, slowly to a stop at the fully opened and fully closed position, and thus to prevent hammering and mechanical damage, cushion pistons, 153 and 155, and cylinders, 156 and 157, are fitted into the valve actuator element. The closing cushion cylinder, 157, is a recessed cylindrical cavity in the actuator piston, 110, and indexes with the closing cushion piston, 155, while the engine valve is completing about the last ten percent portion of its total closing distance, which latter is the valve lift. Correspondingly the opening cushion piston, 153, indexes with the opening cushion cylinder, 156. An oil leakage clearance is provided between the cushion piston and its cushion cylinder so that the oil trapped inside the cushion cylinder, when indexing and hence cushioning commences, can leak out and thus allow full closing and full opening of the engine valve, 15. Additionally a small axial clearance of at least 0.020 inches is provided between the end of the closing cushion piston, 155, and the piston face of the closing cushion cylinder, 157, when the engine valve, 15, is fully closed against the valve seat, 158, to insure that such full closure of the engine valve can always take place.

An oil by pass passage, 159, fitted with a check valve, 160, is provided so that oil may freely enter the closing cushion cylinder, 157, whenever oil is supplied under pressure to the opening end, 124, of the valve actuator element via the connection, 123. In this way the opening of the engine valve is not in any way impeded by the cushion piston and cushion cylinder. The check valve thus seats and seals whenever oil seeks to flow out of the cushion cylinder and unseats and opens whenever oil seeks to flow into the cushion cylinder. A similar by pass passage and check valve are also provided between the opening cushion cylinder, 156, and the closing end, 126, of the valve actuator for this same purpose but these are not shown in FIG. 10 to avoid complicating the drawing unnecessarily.

Figure 11:
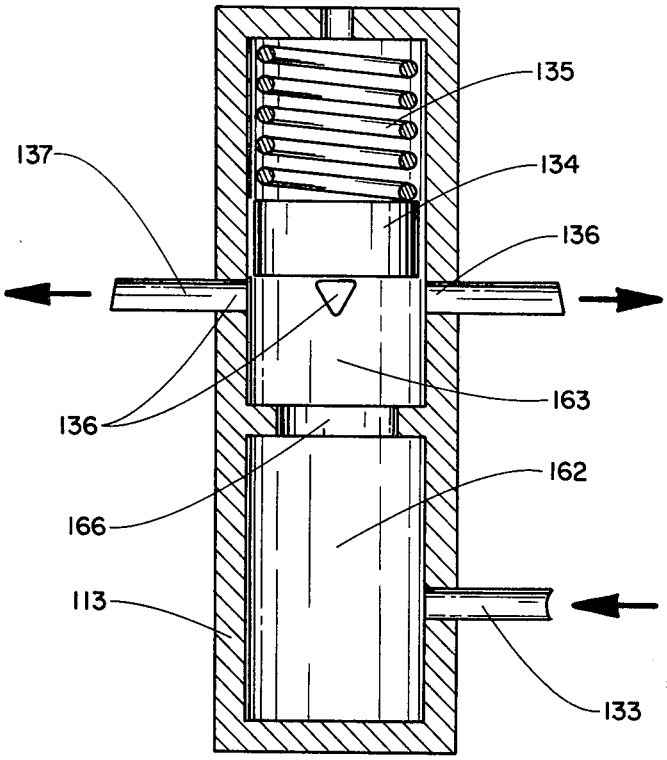
FIG. 11 shows a cross section view of a typical oil reservoir element.

A cross sectional view of an oil reservoir element, 113, is shown in FIG. 11, comprising a reservoir cavity, 162, a reservoir cylinder, 163, a reservoir piston, 134, a reservoir piston spring, 135, a reservoir piston stop, 166, and relief ports, 136. After the flow of oil from the positive displacement oil pump element, 105, has fully opened or closed the engine valve, 15, and hence has caused the valve actuator spill ports, 132, to be uncovered, the further, and excess, flow of oil from the positive displacement oil pump element, 105, flows from the valve actuator spill ports, 132, via the connection, 133, into the reservoir cavity, 162. This excess flow of oil moves the reservoir piston, 134, against the reservoir piston spring, 135, until the relief ports, 136, are uncovered by the reservoir piston, 134. Once the relief ports, 136, are thus uncovered, the excess flow of oil then flows out the relief ports, 136, into the engine oil supply system manifold, 104, via the connection, 137. While the excess flow of oil is thus occurring via the relief ports, 136, the oil pressure in the reservoir cavity, 162, is equal to the force exerted by the reservoir piston springs, 135, divided by the area of the reservoir piston, 134, and can be set to any desired value by a proper selection of these two factors. When the excess flow of oil ceases the reservoir piston spring, 135, forces the reservoir piston, 134, toward the reservoir cavity, 162, until the relief ports, 136, are covered by the reservoir piston, 134. Thereafter the reservoir piston, 134, will move toward the reservoir cavity, 162, only as needed to compensate for oil leakage occuring elsewhere in the oil flow system, until the reservoir piston, 134, comes to rest against the reservoir piston stop, 166. Until the reservoir piston, 134, comes to rest against the reservoir piston stop, 166, the reservoir piston spring, 135, thus acts upon the reservoir piston, 134, to maintain a desired minimum pressure in the reservoir cavity, 162. This minimum pressure can readily be assured by a proper selection of the area of the reservoir piston, 134, and the spring constant and preset compression of the reservoir piston spring, 135, by methods well known in the art. The pressure thus maintained in the reservoir cavity, 162, acts, via the connection, 133, and the valve actuator spill ports, 132, upon the valve actuator piston, 110, to hold the actuator piston, 110, and hence the engine valve, 15, fully open once it has been opened and fully closed once it has been closed. The axial length of the reservoir piston, 134, along its sealing surface with the reservoir cylinder, 163, must be sufficient to hold the relief ports, 136, closed and sealed when the reservoir piston, 134, rests against the reservoir piston stop, 166, to avoid bleeding oil out of the engine oil supply system manifold, 104.

A separate oil reservoir element, 113, may be connected to each individual engine valve, 15, or alternatively, a single oil reservoir element, 113, may be connected to several or all of the engine valves on a multicylinder engine.

For the preferred embodiment of this invention that portion of the engine camshaft devoted to the driving of the engine valves consists of the following components for any one cylinder of a multicylinder gasoline engine:

1. the eccentric, 106, for positively driving the positive displacement oil pump element, 105, which actuates the engine intake valve, 15;
2. the rotating cylindrical passage component, 108, of the valve opening element, 107, which opens the engine intake valve, 15;
3. the rotating cylinder passage component, 61, of the valve closing element which closes the engine intake valve, 15;
4. the eccentric for positively driving the positive displacement oil pump element which actuates the engine exhaust valve;
5. the rotating cylindrical passage component of the valve opening element which opens the engine exhaust valve;
6. the rotating cylindrical passage component of the valve closing element which closes the engine exhaust valve.

This camshaft must be driven positively, as by gears or chains, at exactly one half the rotative speed of the engine crankshaft. The aforelisted six camshaft components are angularly positioned on the camshaft, as described heretofore, so that opening and closing of the engine intake valves and the engine exhaust valves will occur at the proper times relative to the engine piston motion as follows:

a. the engine exhaust valve opens at or somewhat before the time when the engine piston reaches bottom dead center at the end of the expansion stroke;
b. the engine exhaust valve closes at or about the time when the engine piston reaches top dead center at the end of the exhaust stroke;
c. the engine intake valve opens at or about the time when the engine piston reaches top dead center at the end of the exhaust stroke and start of the intake stroke;
d. for maximum engine torque, that is at full throttle, the engine intake valve closes at or about the conventional time when the engine piston reaches bottom dead center at the end of the intake stroke and start of the compression stroke;
e. for reduced engine torque, that is at part throttle, the engine intake valve closes at times, adjustable by adjustment of the non-rotating adjustable port ring, 62, of the engine intake valve closing element, between the conventional intake valve closing time, described above for maximum engine torque, to intake valve closing times later than this during the compression stroke up to, but not including, the time of firing of the engine ignition spark, the later the engine intake valve closing time the less the engine torque.

If alternate positive displacement oil pump elements, such as gear pumps, or alternate types of valve opening elements and valve closing elements, such as cam actuated poppett valves, are used in lieu of the aforedescribed preferred embodiment of this invention the portion of the engine camshaft devoted to the driving of the engine valves must be changed to include only the camshaft rotated portions of the alternate elements.

I claim:

1. The combination of a conventional four stroke cycle gasoline engine, with conventional intake valves and exhaust valves, wherein the improvement comprises replacing the usual torque controlling throttle plate and the conventional intake valve and exhaust valve driving mechanisms with oil flow, positive valve drive mechanisms, said oil flow positive valve drive mechanism comprising, positive displacement oil pump elements one such pump element for each engine intake valve and at least one such pump element for each set of four engine exhaust valves, valve opening elements, valve closing elements, valve actuator elements, and oil reservoir elements, a separate valve opening element and valve closing element and valve actuator element being required for each engine intake valve and each engine exhaust valve, at least one oil reservoir element being required for an engine;

said positive displacement oil pump element being positively driven from an engine shaft so as to positively displace oil via the valve opening element into the opening end of the valve actuator to positively open the engine valve at the proper time relative to the engine piston motion and also so as to positively displace oil via the valve closing element into the closing end of the valve actuator to positively and fully close the engine valve at the proper time relative to the engine piston motion, the displacement of said positive displacement oil pump element being in excess of 4 and preferably in excess of 10 times the valve actuator displacement needed to open the valve and to close the valve, the excess oil thus displaced being directed via spill ports in the valve actuator element into the oil reservoir element and, via the relief ports therein, into the engine oil supply system, said positive displacement pump element being fitted with overpressure relief valves which spill oil back to the sump whenever a pump discharge passage is blocked;

said valve opening element being a pair of valves opened and closed by the camshaft, one valve when open directing the oil from the positive displacement oil pump element to the opening end of the valve actuator element and this supply valve being opened by the camshaft at the time of starting of valve opening and being closed by the camshaft about 90° camshaft thereafter, the other valve when open directing return flow of oil from the closing end of the valve actuator element to the engine oil sump and this latter relief valve being opened by the camshaft when the engine valve has opened sufficiently to cause the spill ports in the valve actuator element to be covered and being closed by the camshaft about 90° camshaft thereafter;

said valve closing element being of two different kinds, an exhaust valve closing element, used for the closing of the engine exhaust valves, and an intake valve closing element, used for the closing of the engine intake valves at times adjustable, via an engine torque control lever, from the conventional intake valve closing time at engine piston near bottom dead center after the engine intake stroke to anytime later than this up to 85 camshaft degrees minus one half the maximum spark ignition advance angle for the engine in crankshaft degrees before piston top dead center, this angle of adjustment being the torque control angle;

said exhaust valve closing element being a pair of valves opened and closed by the camshaft, one valve when open directing the oil from the positive displacement oil pump element to the closing end of the valve actuator element and this supply valve being opened by the camshaft at the time of starting of valve closing and being closed by the camshaft about 90° camshaft thereafter, the other valve when open directing return flow of oil from the opening end of the valve actuator element to the engine oil sump and this latter relief valve being opened by the camshaft when the engine valve has closed sufficiently to cause the spill ports in the valve actuator element to be covered and being closed by the camshaft about 90° camshaft thereafter;

said intake valve closing element being of the same description as the aforedescribed exhaust valve closing element except in that those portions of the supply valve and the relief valve which do not move integrally with the camshaft are secured to the torque control lever and are angularly adjustable with respect to those portions of the supply valve and the relief valve which do move integrally with the camshaft by adjustment of this torque control lever through the previously described torque control angle, said portions of the supply valve and the relief valve which do not move integrally with the camshaft being fitted with connection means which assure maintenance of connections between the portions of the supply valve and the relief valve which do not move integrally with the camshaft and the appropriate supply and delivery connections from the positive displacement oil pump element, to and from the valve actuator element and to the engine oil sump, throughout the full adjustment of the portions of the supply valve and the relief valve which do not move integrally with the camshaft through the torque control angle;

said valve actuator element being a double acting, piston and cylinder actuator with the piston secured to the valve, and the cylinder secured to the engine block and fitted with pressure supply and relief connections at both ends and spill ports in the center which connect to the oil reservoir element, said spill ports being uncovered as the piston reaches the end of its travel to open the valve and to close the valve, cushion pistons and cylinders being fitted internally to the actuator cylinder and piston so as to slow down the velocity of the valve as it nears the fully open and fully closed positions, these cushion pistons being fitted with by pass passages and check valves which permit full application of oil pressure from the positive displacement oil pump element to the entire actuator piston area;

said oil rservoir element being a closed cylindrical cavity with a spring loaded reservoir piston acting to maintain a high pressure within the reservoir, this high pressure acting via a connection to the actuator spill ports to hold the engine valve open when once opened and to hold the engine valve closed when once closed, the reservoir absorbing the excess flow of the positive displacement oil pump element which comes out the actuator spill ports when the engine valve is fully opened and when the engine valve is fully closed, said excess flow moving the reservoir piston against its spring until the reservoir piston has moved sufficiently to uncover a relief port in the reservoir cylinder, after which the excess flow passes via the relief port into the engine oil supply system, the reservoir cylinder being fitted with piston stops which assure that the piston spring always has a preset compression corresponding to that reservoir pressure adequate to hold the engine valve open and closed;

the engine valve driving portion of the engine camshaft consisting of the several drive mechanisms for driving the positive displacement oil pump elements, the portions of the supply valve and the relief valve of the valve opening elements which move integrally with the camshaft, the portions of the supply valve and the relief valve of the valve closing elements which move integrally with the camshaft, all of these being angularly positioned on the camshaft as to open and close the several engine exhaust valves and engine intake valves at the desired time relative to the engine pistons when the camshaft is driven positively, as by gears or chains, at exactly one half the rotative speed of the engine crankshaft.

2. The combination of a conventional four stroke cycle gasoline engine, with conventional intake valves and exhaust valves, wherein the improvement comprises replacing the usual torque controlling throttle plate and the conventional intake valve and exhaust valve driving mechanisms with oil flow, positive valve drive mechanisms, said oil flow positive valve drive mechanism comprising, positive displacement oil pump elements one such pump element for each engine valve, valve opening elements, valve closing elements, valve actuator elements, and oil reservoir elements, a separate valve opening element and valve closing element and valve actuator element being required for each engine intake valve and each engine exhaust valve, at least one oil reservoir element being required for an engine;

said positive displacement oil pump element being positively driven from an engine shaft so as to positively displace oil via the valve opening element into the opening end of the valve actuator to positively open the engine valve at the proper time relative to the engine piston motion and also so as to positively displace oil via the valve closing element into the closing end of the valve actuator to positively and fully close the engine valve at the proper time relative to the engine piston motion, the displacement of said positive displacement oil pump element being in excess of 4 and preferably in excess of 10 times the valve actuator displacement needed to open the valve and to close the valve, the excess oil thus displaced being directed via spill ports in the valve actuator element into the oil reservoir element and, via the relief ports therein, into the engine oil supply system, said positive displacement oil pump element being fitted with overpressure relief valves which spill oil back to the sump whenever a pump discharge passage is blocked;

said valve opening element comprising three valves opened and closed by the camshaft, one valve when open directing the oil from the positive displacement oil pump element to the opening end of the valve actuator element and this supply valve being opened by the camshaft at the time of starting of valve opening and being closed by the camshaft about 90° camshaft thereafter, another valve when open directing return flow of oil from the closing end of the valve actuator element to the engine oil sump and this latter relief valve being opened by the camshaft when the engine valve has opened sufficiently to cause the spill ports in the valve actuator element to be covered and being closed by the camshaft about 90° camshaft thereafter, the third valve when open directing the oil from the positive displacement oil pump element to the engine oil sump and this pump relief valve being opened by the camshaft at least 10° camshaft after the supply valve has been closed and being closed by the camshaft at least ten camshaft degrees before the supply valve is to be opened;

said valve closing element being of two different kinds, an exhaust valve closing element, used for the closing of the engine exhaust valves, and an intake valve closing element, used for the closing of the engine intake valves at times adjustable, via an engine torque control lever, from the conventional intake valve closing time at engine piston near bottom dead center after the engine intake stroke to anytime later than this up to 85° camshaft minus one half the maximum spark ignition advance angle for the engine in crankshaft degrees before piston top dead center, this angle of adjustment being the torque control angle;

said exhaust valve closing element comprising three valves opened and closed by the camshaft, one valve when open directing the oil from the positive displacement oil pump element to the closing end of the valve actuator element and this supply valve being opened by the camshaft at the time of starting of valve closing and being closed by the camshaft about 90° camshaft thereafter, another valve when open directing return flow of oil from the opening end of the valve actuator element to the engine oil sump and this latter relief valve being opened by the camshaft when the engine valve has closed sufficiently to cause the spill ports in the valve actuator element to be covered and being closed by the camshaft about 90° camshaft thereafter, the third valve when open directing the oil from the positive displacement oil pump element to the engine oil sump and this pump relief valve being opened by the camshaft at least 10° camshaft after the supply valve has been closed and being closed by the camshaft at least ten camshaft degrees before the supply valve is to be opened;

said intake valve closing element being of the same description as the aforedescribed exhaust valve closing element except in that those portions of the supply valve, the relief valve and the pump relief valve which do not move integrally with the camshaft are secured to the torque control lever and are angularly adjustable with respect to those portions of the supply valve, the relief valve and the pump relief valve which do move integrally with the camshaft by adjustment of this torque control lever through the previously described torque control angle, said portions of the supply valve, and relief valve and the pump relief valve which do not move integrally with the camshaft being fitted with the connection means which assure maintenance of connections between the portions of the supply valve, the relief valve, and the pump relief valve which do not move integrally with the camshaft and the appropriate supply and delivery connections from the positive displacement oil pump element, to and from the valve actuator element and to the engine oil sump, throughout the full adjustment of the portions of the supply valve, the relief valve and the pump relief valve which do not move integrally with the camshaft through the torque control angle;

said valve actuator element being a double acting, piston and cylinder actuator with the piston secured to the valve, and the cylinder secured to the engine block and fitted with pressure supply and relief connections at both ends and spill ports in the center which connect to the oil reservoir element, said spill ports being uncovered as the piston reaches the end of its travel to open the valve and to close the valve, cushion pistons and cylinders being fitted internally to the actuator cylinder and piston so as to slow down the velocity of the valve as it nears the fully open and fully closed positions, these cushion pistons being fitted with by pass passages and check valves which permit full application of oil pressure from the positive displacement oil pump element to the entire actuator piston area;

said oil reservoir element being a closed cylindrical cavity with a spring loaded reservoir piston acting to maintain a high pressure within the reservoir, this high pressure acting via a connection to the actuator spill ports to hold the valve open when once opened and to hold the valve closed when once closed, the reservoir absorbing the excess flow of the positive displacement oil pump element which comes out the actuator spill ports when the valve is fully opened and when the valve is fully closed, said excess flow moving the reservoir piston against its spring until the reservoir piston has moved sufficiently to uncover a relief port in the reservoir cylinder, after which the excess flow passes via the relief port into the engine oil supply system, the reservoir cylinder being fitted with piston stops which assure that the piston spring always has a preset compression corresponding to that reservoir pressure adequate to hold the valve open and closed;

the engine valve driving portion of the engine camshaft consisting of the several drive mechanisms for driving the positive displacement oil pump elements, the portions of the supply valve, the relief valve and the pump relief valve of the valve opening elements which move integrally with the camshaft, the portions of the supply valve, the relief valve and the pump relief valve of the valve closing elements which move integrally with the camshaft, all of these being angularly positioned on the camshaft as to open and close the several engine exhaust valves and engine intake valves at the desired time relative to the engine pistons when the camshaft is driven positively, as by gears or chains, at exactly one half the rotative speed of the engine crankshaft.

3. The combination of a conventional, four stroke cycle gasoline engine, with conventional intake valves and exhaust valves, wherein the improvement comprises replacing the usual torque controlling throttle plate and the conventional intake valve and exhaust valve driving mechanisms with oil flow, positive valve drive mechanisms, one oil flow, positive, intake valve drive mechanism for each intake valve on the engine and one oil flow, positive, exhaust valve drive mechanism for each exhaust valve on the engine, each such oil flow, positive valve drive mechanism comprising, a positive displacement oil pump element, a valve opening element, a valve closing element, a valve actuator element, and an oil reservoir element;

said positive displacement oil pump element being positively driven from an engine shaft so as to positively displace oil via the valve opening element into the opening end of the valve actuator to positively open the engine valve at the proper time relative to the engine piston motion and also so as to positively displace oil via the valve closing element into the closing end of the valve actuator to positively and fully close the engine valve at the proper time relative to the engine piston motion, the displacement of said positive displacement oil pump element being in excess of 4 and preferably in excess of 10 times the valve actuator displacement needed to open the valve and to close the valve, the excess oil thus displaced being directed via spill ports in the valve actuator element into the oil reservoir element and, via the relief ports therein, into the engine oil supply system, said positive displacement oil pump element being fitted with overpressure relief valves which spill oil back to the sump whenever a pump discharge passage is blocked;

said valve opening element having ports in a nonrotating port ring and passages in a rotating cylindrical passage component driven at camshaft speed, one set of ports indexing with a pressure passage at the time of starting of engine valve opening and for about 90° thereafter to direct the oil from the positive displacement oil pump element to the opening end of the valve actuator element, the other set of ports indexing with a relief passage when the engine valve has opened sufficiently to cause the spill ports in the valve actuator element to be covered and for about 90° camshaft thereafter, to direct return flow of oil from the closing end of the valve actuator element to the engine oil sump;

said valve closing element being of two different kinds, an exhaust valve closing element, used for the closing of the engine exhaust valves, and an intake valve closing element, used for the closing of the engine intake valves at times adjustable, via an engine torque control lever, from the conventional intake valve closing time at engine piston near bottom dead center after the engine intake stroke to anytime later than this up to 85° camshaft minus one half the maximum spark ignition advance angle for the engine in crankshaft degrees before piston top dead center, this angle of adjustment being the torque control angle;

said exhaust valve closing element having ports in a nonrotating port ring and passages in a rotating cylindrical passage component driven at camshaft speed, one set of ports indexing with a pressure passage at the time of starting of engine valve closing and for about 90° camshaft thereafter to direct the oil from the positive displacement oil pump element to the closing end of the valve actuator element, the other set of ports indexing with a relief passage when the engine valve has closed sufficiently to cause the spill ports in the valve actuator element to be covered and for about 90° camshaft thereafter, to direct return flow of oil from the opening end of the valve actuator element to the engine oil sump;

said intake valve closing element having ports in a nonrotating port ring and passages in a rotating cylindrical passage component driven at camshaft speed, one set of ports indexing with a pressure passage at the time of starting of engine valve closing and for about 90° camshaft thereafter to direct the oil from the positive displacement oil pump element to the closing end of the valve actuator element, the other set of ports indexing with a relief passage when the engine valve has closed sufficiently to cause the spill ports in the valve actuator element to be covered and for about 90° camshaft thereafter, to direct return flow of oil from the opening end of the valve actuator element to the engine oil sump, said non-rotating port ring being secured to the torque control lever and being angularly adjustable with respect to the rotating cylindrical passage component by adjustment of this torque control lever, through the previously described torque control angle, said nonrotating but adjustable port ring being fitted with a stationary connection unit which assures maintenance of connections between the non-rotating but adjustable port ring and the appropriate supply and delivery connections from the positive displacement oil pump element, to and from the valve actuator element and to the engine oil sump, throughout the full adjustment of the non-rotating port ring through the torque control angle;

said valve actuator element being a double acting, piston and cylinder actuator with the piston secured to the valve, and the cylinder secured to the engine block and fitted with pressure supply and relief connections at both ends and spill ports in the center which connect to the oil reservoir element, said spill ports being uncovered as the piston reaches the end of its travel to open the valve and to close the valve, cushion pistons and cylinders being fitted internally to the actuator cylinder and piston so as to slow down the velocity of the valve as it nears the fully open and fully closed positions, these cushion pistons being fitted with by pass passages and check valves which permit full application of oil pressure from the positive displacement oil pump element to the entire actuator piston area;

said oil reservoir element being a closed cylindrical cavity with a spring loaded reservoir piston acting to maintain a high pressure within the reservoir, this high pressure acting via a connection to the actuator spill ports to hold the engine valve open when once opened and to hold the engine valve closed when once closed, the reservoir absorbing the excess flow of the positive displacement oil pump element which comes out the actuator spill ports when the engine valve is fully opened and when the engine valve is fully closed, said excess flow moving the reservoir piston against its spring until the reservoir piston has moved sufficiently to uncover a relief port in the reservoir cylinder, after which the excess flow passes via the relief port into the engine oil supply system, the reservoir cylinder being fitted with piston stops which assure that the piston spring always has a preset compression corresponding to that reservoir pressure adequate to hold the engine valve open and closed;

the engine valve driving portion of the engine camshaft consisting of the several eccentrics for driving the positive displacement oil pump elements, the rotating cylindrical passage components of the several valve opening elements, the rotating cylindrical passage components of the several valve closing elements, all of these being angularly positioned on the camshaft as to open and close the several engine exhaust valves and engine intake valves at the desired time relative to the engine pistons when the camshaft is driven positively, as by gears or chains, at exactly one half the rotative speed of the engine crankshaft.

4. The combination of a conventional, four stroke cycle, gasoline engine, with conventional intake valves and exhaust valves, wherein the improvement comprises replacing the usual torque controlling throttle plate and the conventional intake valve and exhaust valve driving mechanisms with oil flow, positive, valve drive mechanisms, one oil flow, positive, intake valve drive mechanism for each intake valve on the engine and one oil flow, positive, exhaust valve drive mechanism for each exhaust valve on the engine, each such oil flow positive valve drive mechanism comprising a positive displacement oil pump element, a valve opening element, a valve closing element, a valve actuator element, and an oil reservoir element;

said positive displacement oil pump element being a double acting, single cylinder and piston pump, the pump piston being driven by an eccentric so positioned on the engine camshaft that the pump piston passes its maximum velocity midstroke point approximately ninety crank degrees before the engine piston reaches its top dead center position, said eccentric being also so positioned on the engine camshaft that the pump piston is moving away from the camshaft when the valve is to be opened and is moving toward the camshaft when the valve is to be closed, the pump cylinder being fitted with pressure actuated suction valves and pressure actuated discharge valves at each end of the cylinder, the passages from the suction valves connecting into the lubricating oil sump of the engine so that the pump is pumping engine lubricating oil, the discharge valve passage from the end of the cylinder away from the camshaft connecting to the pressure supply port of the valve opening element, the discharge valve passage from the end of the cylinder towards the camshaft connecting to the pressure supply port of the valve closing element, each pump discharge passage being fitted with overpressure relief valves which spill oil back to the sump whenever the discharge passage is blocked by closing of the pressure supply port of the valve closing element or the valve opening element;

said valve opening element comprising a non-rotating hollow cylindrical port ring containing four ports, a pressure supply port, connected to the discharge valve passage from the end of the cylinder of the pump element away from the camshaft, a pressure delivery port connected to the opening end of the valve actuator element, this pressure supply port and this pressure delivery port being in a line parallel to the axis of the port ring and spaced apart along this line a distance adequate for sealing purposes, a pressure relief port, connected to the closing end of the valve actuator and a vent port connecting to the engine lubricating oil sump, this pressure relief port and this vent port being in a line parallel to the axis of the port ring and spaced apart along this line a distance adequate for sealing purposes, the axial space occupied by and between the pressure supply port and the pressure delivery port being axially displaced an adequate sealing distance from the axial space occupied by and between the pressure relief port and the vent port, a rotating cylindrical passage component fitting closely to the interior of the non-rotating hollow cylindrical port ring and rotating at camshaft speed therein and having two passages recessed into the exterior cylindrical surface of said rotating cylindrical passage component, the pressure passage connecting the pressure supply port to the pressure delivery port when angularly aligned with these ports, and the relief passage connecting the pressure relief port to the vent port when angularly aligned with these ports, the pressure passage being displaced from the relief passage sufficiently that the pressure passage cannot align with the pressure relief port or the vent port and the relief passage cannot align with the pressure delivery port, the pressure passage being of angular position and extent in the rotating passage component so as to first connect the pressure supply port to the pressure delivery port when the valve is to start opening and to continue this connection for about 90 camshaft degrees thereafter, the relief passage being of angular position and extent in the rotating passage component so as to first connect the pressure relief port to the vent port when the engine valve has opened sufficiently to cause the spill ports in the valve actuator element to be covered, as described hereinafter, and to continue this connection for about 90° camshaft thereafter;

ıid valve closing element being of two different kinds, an exhaust valve closing element and an intake valve closing element;

ıid exhaust valve closing element being of the same description as the aforedescribed valve opening element except that the pressure supply port connects to the discharge valve passage from the end of the cylinder of the pump element toward the camshaft, the pressure delivery port connects to the closing end of the valve actuator element, the pressure relief port connects to the opening end of the valve actuator element, the pressure passage is of angular position and extent in the rotating cylindrical passage component as to first connect the pressure supply port to the pressure delivery port when the valve is to start closing and to continue this connection for about 90° camshaft thereafter, the relief passage is of angular position and extent in the rotating cylindrical passage component as to first connect the pressure relief port to the vent port when the engine valve has closed sufficiently to cause the spill ports in the valve actuator element, to be covered and to continue this connection for about 90° camshaft thereafter;

said intake valve closing element being of the same description as the aforedescribed exhaust valve closing element except that the non-rotating hollow cylindrical port ring can be adjusted angularly about the centerline of the rotating passage component, while the engine is running, through a torque control angle equal in camshaft degrees to 85 minus one half the maximum spark ignition advance angle for the engine in camshaft degrees before piston top dead center, by moving a lever secured to the non-rotating port ring, said lever being the torque control lever for the engine, adjustment of this torque control lever permitting a variation of the intake valve closing time anywhere between the conventional intake valve closing time at engine piston near bottom dead center after the engine intake stroke to any time later than this up to 85° camshaft minus one half the maximum spark ignition advance angle for the engine in crankshaft degrees before piston top dead center, this angle of adjustment being the torque control angle, the non-rotating hollow cylindrical port ring on the intake valve closing element being surrounded by a closely fit, stationary, hollow cylindrical connection ring, the discharge valve passage from the end of the cylinder of the pump element toward the camshaft, the connection to the closing end of the valve actuator element, the connection to the opening end of the valve actuator element and the vent connection to the engine lubricating oil sump are connected separately into individual supply grooves recessed into the interior cylindrical surface of the stationary connection ring, each supply groove always connecting only to the corresponding port in the non-rotating port ring by being axially and angularly aligned with the corresponding port and of about the same width as the port and being of angular extent slightly greater than the torque control angle through which the ports in the nonrotating port ring can be adjusted;

said valve actuator element being a double acting piston and cylinder actuator with the actuator piston secured to the engine valve and fitting closely to the inside bore of the cylinder, the enclosed cylinder interior having a connection at each end for pressure delivery or pressure relief and these connected to the valve opening element and the valve closing element as described heretofore, and a spill port located centrally along the length of the actuator piston motion path, said spill port, when uncovered by the actuator piston, allowing oil, supplied by the positive displacement pump element via the valve closing element and the valve opening element, to flow via a connection to the oil reservoir element, said actuator cylinder being secured to the engine frame and having cushion piston units fixed centrally in both ends, said cushion piston units extending axially into the bore of the actuator cylinder sufficiently to stop the actuator piston and hence the engine valve in the fully open position and in the fully closed position, said actuator piston length being sufficient to just fully open the spill port when the actuator piston is stopped at the engine valve fully open position and at the engine valve fully closed position, said actuator piston being fitted with recessed cylindrical cavities, of internal diameter slightly larger than the external diameter of the cushion piston units, which cavities index accurately with the cushion piston units during the last portions of actuator piston motion, said fixed cushion piston units being fitted internally with a check valve and by pass passage, said check valve allowing oil to flow readily from the actuator cylinder interior, when supplied oil via the pressure delivery connection, to the interior of the recessed cavities in the actuator piston but said check valve preventing the reverse flow of oil from the recessed cavities in the actuator piston to the actuator cylinder interior, said valve actuator element having a displacement, defined as the product of actuator piston area and valve lift, always appreciably smaller than the positive displacement oil pump element displacement, defined as the product of pump piston area and pump piston stroke length, the ratio of positive displacement pump displacement divided by valve actuator displacement in the same units must have a numerical value in excess of 4 and preferably will have a numerical value in excess of 10;

said oil reservoir element being a closed cylinder unit containing a closely fit spring loaded piston operative therein, the cylinder end containing the piston spring being vented to the engine crankcase and the opposite supply end of the cylinder being connected to the spill ports of the valve actuator element so that oil supplied to the reservoir element acts on one side of the reservoir piston the other side of which is acted upon oppositely by the preset compression of the piston spring and engine crankcase pressure, relief ports being positioned on the cylinder wall so that the reservoir is vented thereby to the engine oil supply system whenever the reservoir piston has been sufficiently moved against the piston spring by the oil flow into the supply end of the cylinder as to cause the reservoir piston to uncover these relief ports, the reverse motion of the piston caused by the piston spring force being arrested by piston stops on the cylinder wall after the piston has fully covered the relief ports and moved an additional distance, the piston spring being preset so that appreciable spring force exists when the reservoir piston rests against these piston stops;

the camshaft portion for any one cylinder of the gasoline engine will consist of, the eccentric for driving the positive displacement oil pump element which operates the engine exhaust valve of that engine cylinder, the rotating cylindrical passage component of the exhaust valve opening element, the rotating cylindrical passage component of the exhaust valve closing element, the eccentric for driving the positive displacement oil pump element which operates the engine intake valve of that engine cylinder, the rotating cylindrical passage component of the intake valve opening element, the rotating cylindrical passage component of the intake valve closing element, these several rotating cylindrical passage components and eccentrics being angularly positioned on the camshaft relative to one another and the engine crank of that cylinder of the engine and the desired engine intake valve and engine exhaust valve opening and closing times as has already been described heretofore, the several camshaft portions for a multicylinder gasoline engine being assembled together as a single camshaft with the several camshaft portions angularly positioned relative to one another and relative to the engine crankshaft as to produce the desired order or firing between the several engine cylinders, said assembled single camshaft being driven positively, as by gears or chains, at exactly one half the revolutions per minute of the engine crankshaft, said assembled single camshaft containing cams, gears, etc. as may be desired for driving other components and auxiliaries of the engine such as the ignition distributor, the fuel pump, etc.

5. The combination of a conventional, four stroke cycle, gasoline engine, with conventional intake valves and exhaust valves, wherein the improvement comprises replacing the usual torque controlling throttle plate and the conventional intake valve and exhaust valve driving mechanisms with oil flow, positive, valve drive mechanisms, one oil flow, positive, intake valve drive mechanism for each intake valve on the engine and one oil flow, positive, exhaust valve drive mechanism for each exhaust valve on the engine, each such oil flow positive valve drive mechanism comprising a positive displacement oil pump element, a valve opening element, a valve closing element, a valve actuator element, and an oil reservoir element;

said positive displacement oil pump element being a double acting, single cylinder and piston pump, the pump piston being driven by an eccentric so positioned on the engine camshaft that the pump piston passes its maximum velocity midstroke point approximately 90° crank before the engine piston reaches its top dead center position, said eccentric being also so positioned on the engine camshaft that the pump piston is moving away from the camshaft when the valve is to be opened and is moving toward the camshaft when the valve is to be closed, the pump cylinder being fitted with pressure actuated suction valves and pressure actuated discharge valves at each end of the cylinder, the passages from the suction valves connecting into the lubricating oil sump of the engine so that the pump is pumping engine lubricating oil, the discharge valve passage from the end of the cylinder away from the camshaft connecting to the pressure supply port of the valve opening element, the discharge valve passage from the end of the cylinder towards the camshaft connecting to the pressure supply port of the valve closing element, each pump discharge passage being fitted with overpressure relief valves which spill oil back to the sump whenever the discharge passage is blocked by closing of the pressure supply port of the valve closing element or the valve opening element;

said valve opening element comprising a non-rotating hollow cylindrical port ring containing four ports, a pressure supply port, connected to the discharge valve passage from the end of the cylinder of the pump element away from the camshaft, a pressure delivery port connected to the opening end of the valve actuator element, this pressure supply port and this pressure delivery port being in a line parallel to the axis of the port ring and spaced apart along this line a distance adequate for sealing purposes, a pressure relief port, connected to the closing end of the valve actuator and a vent port connecting to the engine lubricating oil sump, this pressure relief port and this vent port being in a line parallel to the axis of the port ring and spaced apart along this line a distance adequate for sealing purposes, the axial space occupied by and between the pressure supply port and the pressure delivery port being axially displaced an adequate sealing distance from the axial space occupied by and between the pressure relief port and the vent port, a rotating cylindrical passage component fitting closely to the interior of the non-rotating hollow cylindrical port ring and rotating at camshaft speed therein and having passages recessed into the exterior cylindrical surface of said rotating cylindrical passage component, the pressure passage connecting the pressure supply port to the pressure delivery port when angularly aligned with these ports, the relief passage connecting the pressure relief port to the vent port when angularly aligned with these ports, and the pump relief passage connecting the pressure supply port to the vent port when angularly aligned with these ports, the pressure passage being axially and angularly displaced from the relief passage and the pump relief passage sufficiently that the pressure passage cannot align with the pressure relief port or the vent port and the relief passage cannot align with the pressure delivery port, the pressure passage being of angular position and extent in the rotating passage component so as to first connect the pressure supply port to the pressure delivery port when the valve is to start opening and to continue this connection for about 90° thereafter, the relief passage being of angular position and extent in the rotating passage component so as to first connect the pressure relief port to the vent port when the engine valve has opened sufficiently to cause the spill ports in the valve actuator element to be covered, as described hereinafter, and to continue this connection for about 90° camshaft thereafter, the pump relief passage being of angular position and extent in the rotating passage component so as to first connect the pressure supply port to the vent port at least 10° camshaft after the pressure passage has ceased to connect the pressure supply port to the pressure delivery port and to continue this connection until at most ten camshaft degrees before the pressure passage again connects the pressure supply port to the pressure delivery port;

said valve closing element being of two different kinds, an exhaust valve closing element and an intake valve closing element;

said exhaust valve closing element being of the same description as the aforedescribed valve opening element except that the pressure supply port connects to the discharge valve passage from the end of the cylinder of the pump element toward the camshaft, the pressure delivery port connects to the closing end of the valve actuator element, the pressure relief port connects to the opening end of the valve actuator element, the pressure passage is of angular position and extent in the rotating cylindrical passage component as to first connect the pressure supply port to the pressure delivery port when the valve is to start closing and to continue this connection for about 90 camshaft degrees thereafter, the relief passage is of angular position and extent in the rotating cylindrical passage component as to first connect the pressure relief port to the vent port when the engine valve has closed sufficiently to cause the spill ports in the valve actuator element, to be covered and to continue this connection for about 90° camshaft thereafter;

said intake valve closing element being of the same description as the aforedescribed exhaust valve closing element except that the non-rotating hollow cylindrical port ring can be adjusted angularly about the centerline of the rotating passage component, while the engine is running, through a torque control angle equal in camshaft degrees to 85 minus one half the maximum spark ignition advance angle for the engine in camshaft degrees before piston top dead center, by moving a lever secured to the non-rotating port ring, said lever being the torque control lever for the engine, adjustment of this torque control lever permitting a variation of the intake valve closing time anywhere between the conventional intake valve closing time at engine piston near bottom dead center after the engine intake stroke to any time later than this up to 85 camshaft degrees minus one half the maximum spark ignition advance angle for the engine in crankshaft degrees before piston top dead center this angle of adjustment being the torque control angle, the non-rotating hollow cylindrical port ring on the intake valve closing element being surrounded by a closely fit, stationary, hollow cylindrical connection ring, the discharge valve passage from the end of the cylinder of the pump element toward the camshaft, the connection to the closing end of the valve actuator element, the connection to the opening end of the valve actuator element and the vent connection to the engine lubricating oil sump are connected separately into individual supply grooves recessed into the interior cylindrical surface of the stationary connection ring, each such supply groove always connecting only to the corresponding port in the non-rotating port ring by being axially and angularly aligned with the corrresponding port and of about the same width as the port and being of angular extent slightly greater than the torque control angle through which the ports in the non-rotating port ring can be adjusted;

said valve actuator element being a double acting piston and cylinder actuator with the actuator piston secured to the engine valve and fitting closely to the inside bore of the cylinder, the enclosed cylinder interior having a connection at each end for pressure delivery or pressure relief and these connected to the valve opening element and the valve closing element as described heretofore, and a spill port located centrally along the length of the actuator piston motion path, said spill port, when uncovered by the actuator piston, allowing oil, supplied by the positive displacement pump element via the valve closing element and the valve opening element, to flow via a connection to the oil reservoir element, said actuator cylinder being secured to the engine frame and having cushion piston units fixed centrally in both ends, said cushion piston units extending axially into the bore of the actuator cylinder sufficiently to stop the actuator piston and hence the engine valve in the fully open position and in the fully closed position, said actuator piston length being sufficient to just fully open the spill port when the actuator piston is stopped at the engine valve fully open position and at the engine valve fully closed position, said actuator piston being fitted with recessed cylindrical cavities, of internal diameter slightly larger than the external diameter of the cushion piston units, which cavities index accurately with the cushion piston units during the last portions of actuator piston motion, said fixed cushion piston units being fitted internally with a check valve and by pass passage, said check valve allowing oil to flow readily from the actuator cylinder interior, when supplied oil via the pressure delivery connection, to the interior of the recessed cavities in the actuator piston but said check valve preventing the reverse flow of oil from the recessed cavities in the actuator piston to the actuator cylinder interior, said valve accuator element having a displacement, defined as the product of actuator piston area and valve lift, always appreciably smaller than the positive displacement oil pump element displacement, defined as the product of pump piston area and pump piston stroke length, the ratio of positive displacement pump displacement divided by valve actuator displacement is the same units must have a numerical value in excess of 4 and preferably will have a numerical value in excess of 10;

said oil reservoir element being a closed cylinder unit containing a closely fit spring loaded piston operative therein, the cylinder end containing the piston spring being vented to the engine crankcase and the opposite supply end of the cylinder being connected to the spill ports of the valve actuator element so that oil supplied to the reservoir element acts on one side of the reservoir piston the other side of which is acted upon oppositely by the preset compression of the piston spring and engine crankcase pressure, relief ports being positioned on the cylinder wall so that the reservoir is vented thereby to the engine oil supply system whenever the reservoir piston has been sufficiently moved against the piston spring by the oil flow into the supply end of the cylinder as to cause the reservoir piston to uncover these relief ports, the reverse motion of the piston caused by the piston spring force being arrested by piston stops on the cylinder wall after the piston has fully covered the relief ports and moved an additional distance, the piston spring being preset so that appreciable spring force exists when the reservoir piston rests against these piston stops;

the camshaft portion for any one cylinder of the gasoline engine will consist of, the eccentric for driving the positive displacement oil pump element which operates the engine exhaust valve of that engine cylinder, the rotating cylindrical passage component of the exhaust valve opening element, the rotating cylindrical passage component of the exhaust valve closing element, the eccentric for driving the positive displacement oil pump element which operates the engine intake valve of that engine cylinder, the rotating cylindrical passage component of the intake valve opening element, the rotating cylindrical passage component of the intake valve closing element, these several rotating cylindrical passage components and eccentrics being angularly positioned on the camshaft relative to one another and the engine crank of that cylinder of the engine and the desired engine intake valve and engine exhaust valve opening and closing times as has already been described heretofore, the several camshaft portions for a multicylinder gasoline engine being assembled together as a single camshaft with the several camshaft portions angularly positioned relative to one another and relative to the engine crankshaft as to produce the desired order of firing between the several engine cylinders, said assembled single camshaft being driven positively, as by gears or chains, at exactly one half the revolutions per minute of the engine crankshaft, said assembled single camshaft containing cams, gears, etc as may be desired for driving other components and auxiliaries of the engine such as the ignition distributor, the fuel pump, etc.

* * * * *